United States Patent [19]

Vinal

[11] 4,156,610

[45] May 29, 1979

[54] COPPER PHYSICAL DEVELOPMENT USING HETEROCYCLIC LIGAND COPPER(I) COMPLEXES

[75] Inventor: Richard S. Vinal, Rochester, N.Y.

[73] Assignee: Eastman Kodak Company, Rochester, N.Y.

[21] Appl. No.: 833,622

[22] Filed: Sep. 15, 1977

[51] Int. Cl.[2] ..... G03C 5/24; G03C 1/48

[52] U.S. Cl. ..... 96/48 PD; 106/1.25; 106/1.26; 96/76 R; 428/913; 428/457; 427/430 A; 427/265; 427/301

[58] Field of Search ..... 96/48 PD, 48 HD, 76 R, 96/29 R; 427/430 A, 265, 301; 106/1.25, 1.26; 428/913, 457

[56] References Cited

U.S. PATENT DOCUMENTS

| | | | |
|---|---|---|---|
| 3,512,972 | 5/1970 | Case | 96/48 PD |
| 3,598,587 | 8/1971 | Yudelson et al. | 96/48 PD |
| 3,647,439 | 3/1972 | Bass | 96/48 PD |
| 3,655,383 | 4/1972 | Shepard et al. | 96/48 PD |
| 3,669,670 | 6/1972 | Haist et al. | 96/114.1 |
| 3,674,489 | 7/1972 | Wyman | 96/48 PD |
| 3,843,363 | 10/1974 | Lehman | 96/48 PD |
| 3,959,531 | 5/1976 | Schneble et al. | 106/1.26 |

*Primary Examiner*—Won H. Louie, Jr.
*Attorney, Agent, or Firm*—J. Jeffrey Hawley

[57] ABSTRACT

Copper physical development using certain heterocyclic ligand copper(I) complexes which are resistant to aerial oxidation is disclosed. The copper(I) complexes can be represented by the formula $$L(CuX)_m$$

wherein L is a monodentate or bidentate heterocyclic ligand, X is an anion and m is the integer 1 or 2. The described physical development compositions can operate in either the disproportionation mode, in which case the composition further comprises, in addition to the copper(I) complex, a ligand for copper(II); or in the reduction mode, in which case the composition further comprises a reducing agent and preferably a base. Generally, nuclei of metals from group VIII and IB of the periodic table are catalytic for the deposition of copper from these compositions. The nuclei can be imagewise formed by exposing an electromagnetic radiation sensitive compound. Physical development formulations, processes and elements are disclosed.

28 Claims, No Drawings

COPPER PHYSICAL DEVELOPMENT USING HETEROCYCLIC LIGAND COPPER(I) COMPLEXES

FIELD OF THE INVENTION

This invention relates to photographic processes, elements and physical developer formulations. More particularly, it relates to the imagewise deposition of copper from stable compositions.

DISCUSSION OF THE PRIOR ART

Conventional physical development comprises the development of a catalyst by treating the catalyst with a developer composition which contains a reducible metal compound and a reducing agent. In physical development, virtually all of the metal in the visual image comes from metal ions supplied by the metal compound in the developer composition. It is desirable that the physical developer composition be so formulated that it is stable under conditions of storage, but that in the presence of catalyst it decomposes and deposits metal on the catalytic sites. The most common type of physical developer composition is a simple solvent solution of the heavy metal compound and a reducing agent. It is also known, that a physical developer composition can comprise a reducible metal salt and a reducing agent dispersed in a suitable binder. This latter type of physical developer composition can be coated onto a support to provide a physical development layer.

Physical development involving silver compounds is well known. However, such processes have not had any substantial commercial application, except in very specialized applications, due to the fact that known silver physical developer solutions are extremely unstable. Thus, shortly after a physical developer solution, is prepared by mixing silver salts and reducing agents, reduced silver begins to deposit rapidly, so that in a few hours the bath is completely decomposed and is of no practical utility. This type of instability is inherent in silver physical developer solutions since the poor autocatalytic properties of silver metal require that silver physical developer solutions be formulated so as to be capable of depositing silver very rapidly, if inordinately long development times are to be avoided. Other known physical developers contain a variety of reducible metal salts such as salts of nickel, cobalt, iron and chromium. A general description of physical development can be found in Hornsby, Basic Photographic Chemistry, (1956) 66 and Mees and James, The Theory of the Photographic Process, (3rd ed 1966) 329–331.

Physical development involving copper compounds is also well known. For example, a commercially available copper physical developer contains a copper salt such as copper sulfate, formaldehyde, Rochelle salt, and nickel sulfate. (Copper Enplate developer baths manufactured by Enthone, Inc.) In U.S. Pat. No. 3,512,972 to Case there is described another copper physical developer composition. This physical developer contains a cupric salt in combination with ascorbic acid and preferably an acid acceptor such as an amine. While these prior art copper physical developers are useful for depositing copper on catalytic sites, they suffer from several disadvantages. These copper physical developers are subject for example, to aerial oxidation. Thus, care must be taken with these physical developers to exclude the presence of air if they are to be stored for long periods of time. Further, these physical developers typically use highly colored copper salts such as copper sulfate or copper nitrate, making it difficult to adapt these developers to dry physical development elements. It will be readily appreciated that the highly colored copper salt will form undesirable stain in undeveloped areas in many of these elements.

It is known in the art that various copper complexes are light sensitive and can be coated along with a suitable binder on a support to form a photographic element. Most of the known light sensitive copper complexes however, are relatively resistant to reduction. Thus, light sensitive copper complexes such as those described in U.S. Pat. No. 3,859,092 are not suitable for use as the reducible copper compound in a conventional reduction physical developer composition.

There is a continuing need for copper physical developers. It would be desirable to have copper physical developers which would be relatively stable such as to aerial oxidation and yet would easily decompose in the presence of a catalyst. It would further be desirable if the reducible copper compound of the physical developer were neutral in color so that dry physical development elements could be made.

SUMMARY OF THE INVENTION

I have found that certain copper complexes are extremely useful in physical development compositions. These copper complexes are heterocyclic ligand complexes of copper(I) and can be represented by the formula $L(CuX)_m$ wherein L is a monodentate or bidentate heterocyclic ligand selected from the group consisting of:

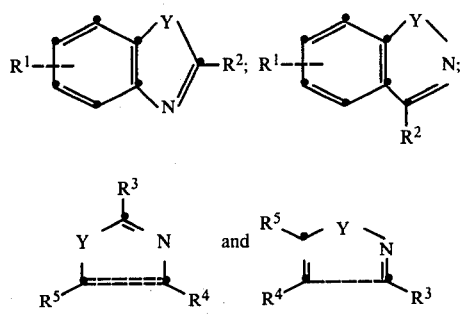

wherein Y is oxygen or sulfur; $R^1$ is alkyl having from 1 to 20 carbon atoms such as methyl, ethyl, isopropyl, cyclohexyl and the like or aryl having from 6 to 20 carbon atoms such as phenyl, tolyl, xylyl and the like; $R^2$ through $R^5$ are independently selected from the group consisting of hydrogen, alkyl having from 1 to 20 carbon atoms as described above and aryl having from 6 to 20 carbon atoms also as described above; with the proviso that at least one of $R^3$ through $R^5$ is hydrogen;

X is an anion such as halide such as chloride, bromide and the like; thiocyanate and the like; and m is the integer 1 or 2.

It is understood throughout the specification and claims that the terms "alkyl" and "aryl" include cycloalkyl and substituted alkyl and aryl. Such substituents include chloroethyl, benzyl, norbornyl, cyclohexyl, methoxy, thiomethyl, benzenesulfonamido and the like. Any substituent can be used as long as it does not interfere with the reduction of metal onto the catalyst.

These copper complexes deposit copper onto catalytic latent images either conventionally by way of reduction with a reducing agent or by disproportionation.. The disproportionation deposition of copper from these complexes takes place in the presence of an organic ligand for copper(II). This reaction can generally be represented by the following formula:

$$2L(CuX) \xrightarrow{L'} Cu(O) + L'Cu(II) + 2X^{\ominus} + 2L$$

Where X and L are defined above and L' is the organic copper(II) ligand.

Thus, in one aspect of the present invention there is provided a physical developer formulation comprising:

(a) a solvent;

(b) a copper(I) complex described above; and (c) an organic ligand for copper(II).

In another aspect of the present invention there is provided a physical developer formulation also comprising a solvent and the heterocyclic ligand copper(I) complex described above. Instead of the organic ligand for copper(II) however, this second physical developer formulation comprises a reducing agent capable of reducing the copper(I) complex in the presence of catalytic nuclei but which does not spontaneously reduce the copper(I) complex. As is well known in the art, this second reduction type physical developer solution preferably contains a base to neutralize hydrogen ions formed in the reduction reaction and thereby displace the equilibrium of the reaction to favor the deposition of copper.

The physical developer formulation described above can be used to deposit copper on catalytic metal nuclei. Thus, in another aspect of the present invention, there is provided a process for producing a copper image comprising the steps of:

(a) imagewise forming catalytic metal nuclei; and (b) catalytically disproportionating the copper(I) complex described above in contact with the nuclei in the presence of an organic ligand for copper(II).

In yet another aspect of the present invention there is provided a process as described above wherein the catalytic disproportionation step is replaced by the step of catalytically reducing the copper(I) complex described above in contact with the nuclei, with a reducing agent that does not spontaneously reduce the copper(I) complex.

The copper(I) complexes described above are neutral in color, generally white. Thus, the complexes can be included in various dry physical development elements without undesirable stain. A photographic element according to the present invention can comprise a support having coated thereon (a) a layer comprising a compound capable of forming an image of catalytic nuclei on exposure to imagewise electromagnetic radiation;

(b) a layer comprising the copper(I) complex described above;

(c) a layer which can be layer (b) or a different layer comprising a reducing agent capable of reducing the copper(I) complex in the presence of the nuclei but which does not spontaneously reduce the copper(I) complex; and (d) a layer which can be layer (b) or (c) or a different layer comprising a thermal solvent, said layers being in reactive association.

In another aspect, a copper physical development composition of the present invention may be simply coated onto a suitable support to form an amplification element. Such an amplification element may be laminated in contact with an element having thereon an imagewise distribution of catalytic nuclei. Heating of the laminate causes copper physical development in the image areas. Thus, there is provided an amplification element comprising:

(a) a layer comprising the copper(I) complex described above;

(b) a layer which can be layer (a) or a different layer comprising a reducing agent capable of reducing the copper(I) complex in the presence of catalytic nuclei but which does not spontaneously reduce the copper(I) complex;

(c) a layer which can be layer (a) or (b) or a different layer comprising a thermal solvent, said layers being in reactive association.

The copper physical development compositions, processes, and elements described herein provide several advantages over the compositions of the prior art. Most importantly, copper physical development compositions containing the heterocyclic ligand copper(I) complexes described above are resistant to aerial oxidation. Thus, the physical developer solutions can be stored for long periods without extraordinary precautions to exclude the presence of air. Also because of this property, the elements described above have long shelf lives. In spite of this stability to long term storage, the copper physical development compositions described herein readily deposit copper in the presence of catalytic nuclei. Another significant advantage of the copper(I) complexes described above in relation to their use in physical development compositions, is that they are soluble in organic solvents. Because of this property it is possible to form nonaqueous physical developer solutions thereby avoiding the drying and dimensional stability problems that are inherent in aqueous systems.

DETAILED DESCRIPTION OF THE INVENTION

Copper complexes having the formula $L(CuX)_m$, as described above, can be made by adding the heterocyclic compound described as L above to a freshly prepared solution of a cupric salt and a reducing agent in an organic solvent. The reaction mixture is then given good agitation and the desired complex precipitates either immediately or over a period of about 30 minutes to several hours depending upon the heterocycle used as the ligand. The product is then collected, washed with a nonsolvent and air dried.

Generally, equivalent amounts of the cupric salt and reducing agent are used. The heterocyclic compound L is used in excess of the stoichiometric amount, desirably from 10 to 50% or more in excess per mole of the cupric salt. The particular value for m in the equation above depends on the strength of the ligand and the amount used. Where a large excess of ligand L is used, m will be 1; where only a small amount of a weak ligand is used m will tend to be 2. The particular value of m is not critical. The reaction is generally carried out under ambient temperature and pressure, however, higher and lower temperatures and pressures can be used.

A wide variety of cupric salts can be used for the preparation of the cuprous complexes described above. Cupric halides such as chloride, bromide, and the like, however, are the preferred salts. The solvent can be any solvent in which the reactants are soluble and the complex is less soluble. Typically, solvents such as alcohols including methanol, ethanol and the like can be used. The reducing agent used to form the cuprous complex from the cupric salt should be selected so that it has a stabilizing effect upon the cuprous intermediate. Reducing agents which tend to coordinate and which form soluble intermediates with copper(I) are particularly useful. Preferred reducing agents include triphenyl phosphite, phenyl hydrazine and ascorbic acid.

Exemplary copper complexes which can be prepared in this manner include:

3,5-dimethylisoxazole$(CuBr)_2$
2-methylbenzoxazole(CuCl)
benzoxazole(CuBr)
2-methylbenzothiazole(CuBr)
2-methylbenzoxazole(CuBr)
3,5-dimethylisoxazole$(CuCl)_2$
4,5-dimethylisoxazole(CuBr)
3-methyl-5-phenylisoxazole$(CuBr)_2$
3-methyl-5-phenylisoxazole(CuCl)

Complexes wherein the coordinating ligand is a benzoxazole or a benzothiazole are preferred.

As described above, the physical developers of the present invention can operate in either the reduction or the disproportionation mode. The reduction physical developer contains the heterocyclic ligand copper(I) complex, a reducing agent and preferably a base. The proportions of the various components in the reduction physical developer can vary over a wide range. Suitable concentrations of the copper(I) complex can range from about 0.005 mole to about 0.5 mole of complex per liter of solution. The upper limit of the concentration is dependent upon the solubility of the particular complex in the solvent chosen. Preferably, the solution is about 0.01 molar to about 0.1 molar with respect to the copper(I) complex. The relative proportions of the copper complex and the reducing agent depend upon the particular complex and the particular reducing agent. Typically, the reducing agent can be present in amounts from about 0.01 mole to about 5 moles of reducing agent per mole of copper complex in the composition. It is preferred that at least 1 equivalent of reducing agent be present in the composition for each equivalent of copper(I) complex. Where a base is used to neutralize the acid that is formed on the deposition of copper from the physical developer, substantially equimolar amounts of the base and the reducing agent are preferred. However, greater and lesser quantities of the base can be used.

The physical developers described herein are useful over a wide range of temperatures and times. At room temperature with some complexes, particularly complexes coordinated to highly substituted ligands, elevated temperatures are useful in order to decrease processing time. Typically, any temperature up to the decomposition temperature of the complex is useful. Generally, temperatures range between about 20° C. and about 75° C.

The disproportionation physical developers can contain substantially the same amounts of the heterocyclic ligand copper(I) complexes as the reduction physical developers. The relative proportions of the copper(I) complex and the complexing agent (organic ligand) for copper(II) are dependent upon the particular copper(I) complex, the particular complexing agent and the ligand coordinated to the copper(I) complex. Typically, the complexing agent can be present in amounts from about 1 to about 20 moles of complexing agent per mole of copper(I) complex. A preferred range of copper (II) complexing agent in the disproportionation physical developer is between about 1 to about 10 moles per mole of copper(I) complex in the solution. The preferred amount depends on the relative strength of the copper(II) and copper(I) ligands. For example, if the copper(II) ligand is weak relative to the ligand already attached to the copper(I), amounts of copper(II) ligand on the upper end of this range are preferred. The optimum amount can be determined by simple experiment.

Both the disproportionation and the reduction physical developers are operative over a wide range of pH, depending on development conditions such as temperature. The physical developer can be brought to the desired pH by an addition of an appropriate amount of suitable base. As discussed above, additional base is particularly preferred for the reduction physical developer. For example, in aqueous systems the optimum pH for the reduction physical developer is typically between about 8 and 13 while for the disproportionation phyysical developer it is typically between about 9 and 13. Non-aqueous developers should also be similarly basic. Preferred bases that can be added to the physical developer formulations include guanidine; hexamethylenetetraamine; triethylenediamine; mono-, di- and triethanolamine and dimethylethanolamine, although other bases are useful. The formulation can be maintained at the desired pH by the addition of a suitable buffering system, for example, sodium carbonate and sodium bicarbonate. Other buffering materials can be readily determined by those skilled in the art.

The physical developer can include a variety of other materials to facilitate the maintenance and operation of the developer and to improve the quality of the developed image. Suitable addenda include preservatives, thickening agents, brightening agents and the like. The rates of development can be increased and hence the time of development decreased, by adding to the developer a surfactant such as an alkyl metal salt of a sulfated fatty acid, e.g., dodecyl sodium sulfate.

Solvents which are useful for preparing physical developer formulations of the present invention can be any of a wide variety of solvents. The solvent should be chosen so that as much as possible of the copper(I) complex is dissolved and that all of the remaining components are soluble and yet be one which does not adversely affect a photographic element processed in the physical developer. Although water can be used as a solvent, organic solvents are preferred. Typical organic solvents which are useful include polar solvents such as alcohols including methanol, ethanol, and ethylene glycol. Mixtures of solvents can also be used.

Reducing agents which are useful in the reduction physical developers described above should be chosen so that they are capable of reducing the heterocyclic ligand copper(I) complex in the presence of catalytic nuclei but do not spontaneously reduce the copper(I) complex. By spontaneously, it is meant that copper(O) is formed essentially instantaneously without the metal nuclei. It should be understood that the physical developer is useful if it is stable to reduction for a time long enough to process an element. Typically, however, reduction physical developer baths of this invention are stable for one hour or longer. One method of extending the life of the reduction physical developers is to store the components in three separate solutions. One solution contains the copper(I) complex. Because of the nature of the complexes described herein, this solution is extremely stable to aerial oxidation. A second solution contains an acidic solution of the reducing agent.

The third solution contains sufficient base so that when the three solutions are mixed, a basic solution results.

Reducing agents which are useful in the reduction physical developer compositions include reducing agents which are generally useful in silver halide photography such as hydroquinones, catechols and pyrogallols; ascorbic acid and its derivatives such as ascorbates. Other useful reducing agents are disclosed in Chapter 13 of Mees and James, "The Theory of the Photographic Process", third edition, New York, 1966. Mixtures of reducing agents can also be used. A mixture of a hydroquinone and ascorbic acid or an ascorbate is preferred.

Copper(II) organic ligands or complexing agents which are useful in the disproportionation physical developers described above can be any of the complexing agents which are well known in the art. Preferably, the copper(II) complexing agent should strongly coordinate the copper(II) so as to drive the disproportionation reaction towards the deposition of copper from the physical developer bath. The stability constant for copper(II) for the copper(II) ligand should be greater than the stability constant for copper(II) for the ligand in the copper(I) complex. Useful complexing agents include amines such as triethylenetetraamine, diethylenetriamine and the like; glycine; carboxylic acids such as tartaric, citric and oxalic acid; ethylene diamine tetraacetic acid, and pyrophosphate. Triethylenetetraamine is the preferred copper(II) complexing agent.

A large variety of catalysts are catalytic for the disproportionation or reduction of the copper(I) complex from the physical developer compositions of the invention. Thus, the process of the present invention comprises the steps of:

(a) imagewise forming catalytic metal nuclei and (b) catalytically disproportionating or reducing the described heterocyclic ligand copper(I) complex in contact with the nuclei. In preferred embodiments the imagewise catalytic nuclei are formed by imagewise exposing to electromagnetic radiation an electromagnetic radiation sensitive compound of a metal from group VIII or IB of the periodic table. Palladium complexes which are useful in forming the catalytic nuclei of this invention may be described by the general formula:

$$[Pd(A)_a(B)_b(C)_c(D)_d]_eG_g \quad (I)$$

wherein

A, B, C, D are anionic or neutral ligands which can be the same or different and may be chosen from the group consisting of halide ligands such as bromide, chloride, or iodide, a carboxylic acid ligand such as a malonate group, an oxalate group, etc., an aromatic ligand such as phenyl, styrene, naphthyl, etc., a nitrogen ligand such as ammonia, an amine such as methylamine, ethylamine, benzylamine, ethylenediamine, propanediamine, diethylenetriamine, tetraethylenepentamine, aminoethanol, methylaminoethanol, aminonaphthol, bipyridine, phenanthroline, ethylenediaminetetraacetic acid, etc., a nitrile such as nitrilotriethanol, benzonitrile, etc., an imine such as iminodiethanol, an oxime such as salicylaldoxime or an azide such as benzhydrazide, a phosphorous ligand such as triarylphosphine, trialkylphosphine, trialkylphosphite, triarylphosphite etc., an arsenic ligand such as triarylarsine, trialkylarsine, etc., an antimony ligand such as triarylantimony, trialkylstibine, etc., thiocyanate, selenocyanate, telluorocyanate, nitrate, acetate and a sterically hindered polydentate ligand such as tetraethyldiethylenetriamine and the like, G is a counter cation or anion depending on the overall charge of $[Pd(A)_a(B)_b(C)_c(D)_d]$ such as a hydrogen ion, an inorganic acid ion such as a chloride ion, a bromide ion, an iodide ion, a sulfate ion, a nitrate ion, a phosphate ion, etc., an organic acid ion such as an acetate ion, an acrylate ion, a malonate ion, etc., a metal ion such as a sodium ion, a potassium ion, a calcium ion, a strontium ion, an aluminum ion, etc., an onium ion such as those containing nitrogen, phosphorus or sulfur like a quaternary ammonium ion, a quaternary phosphonium ion, a tertiary sulfonium ion, etc., and the like, G can also be tetraarylborate and, a, b, c and d are integers from 0 through 4;

a+b+c+d is an integer from 1 through 4;

e is 1 or 2; and g is an integer from 0 through 8.

A useful class of palladium compounds is represented by the formula $$[PdLX]B(C_6H_5)_4$$

where L is the ligand N,N,N',N'-tetraethyldiethylenetriamine and X is halide such as $Cl^{\ominus}$, $Br^{\ominus}$ or $I^{\ominus}$; $SCN^{\ominus}$, $SeCN^{\ominus}$ or $BH_3CN^{\ominus}$. Typical palladium compounds described above are found in U.S. Pat. No. 3,719,490 to Yudelson and copending application Ser. No. 567,668, filed Apr. 14, 1975 by Gysling and Lelental entitled "Physical Development of Pd(II) Photosensitive Complexes," which are hereby incorporated by reference.

Photosensitive copper(I) compounds which are useful to provide catalytic copper nuclei are described in U.S. Pat. No. 3,860,500, hereby incorporated by reference, and can be represented by the formula $$Cu[P(OR)_3]_nBN_3CN \quad (II)$$

wherein R is lower alkyl and n is an integer from 1 to 3.

Additional photosensitive copper(I) complexes useful to form catalytic copper nuclei are described in U.S. Pat. No. 3,859,092 issued Jan. 7, 1975 hereby incorporated by reference and can be represented by the formulas $$[CuQ_{q1}V] \quad \text{or} \quad (III)$$

$$[CuQ_{q2}]V^1 \quad (IV)$$

In the first instance (formula III), the copper (I), the ligand, and the anion were all coordinated so that the copper(I) ion has a coordination number of 2, 3, or 4.

Q is a monodentate or polydentate class b ligand which, when monodentate, has the formula WZ where W is a group V or group VI donor atom such as nitrogen, phosphorous, arsenic, antimony, bismuth, sulfur, selenium, and tellurium and Z represents the nonmetallic atoms needed to complete the ligand. When the ligand is bidentate, Q has the formula BWZ where B and W are donor atoms from group V or group VI and Z is as described above. Where the ligand is tridentate, Q has the formula BWYZ where Y is a donor atom and where the ligand is tetradentate, Q has the formula BWYY'Z where Y and Y' are non-coordinating anions.

The value of q1 is an integer from 1 to 3 when Q is monodentate and 1 or 2 when Q is polydentate.

V is a monovalent coordinating anion. Examples of this art recognized class of materials are $BH_3CN^{\oplus}$, $N_3^{\oplus}$, $NO_3^{\oplus}$, halide ions such as $Cl^{\oplus}$, $Br^{\oplus}$, and $I^{\oplus}$, and boranes such as $BH_4^{\oplus}$ and $B_9H_{13}^{\oplus}$. Monovalent coordinating anions useful herein are described in Cotton and Wilkinson, *Advanced Inorganic Chemistry,* 2nd ed., Chapter 26, N.Y. (1966).

In the complex $[CuQ_{q2}]V^1$, (formula IV) the ligand is coordinated to the copper(I) but the anion is not. The coordination number of the Cu ion due to complexation by Q is 4.

The integer q2 is either 2 or 4 and Q is as described above. When q2 is 2, Q is a bidentate ligand such as 1,2-bis(phenylseleno)ethane, 1,4-bis(ethyltelluro)butane, or the like and when q2 is 4, Q is a monodentate ligand such as propyl sulfide, triphenylphosphine, triphenylstibine, tripropylarsine or the like.

$V^1$ is a non-coordinating monovalent anion. Examples of non-coordinating anions useful with the above Cu complexes are those having the formula $[BLMNR]^{1-}$ wherein L, M, N and R are independently selected from the group consisting of aryl and alkyl such as tetraethylborate, tetraphenylborate and the like; perchlorate; nitrate; or tetrafluoroborate; and the like. Some non-coordinating anions can coordinate in certain cases depending on the nature of the ligands in the coordination sphere. Thus, nitrate is coordinated in $[Cu[P(C_6H_5)_3]_2NO_3]$, but non-coordinated in $Cu[NC(CH_2)_4CN]_2NO_3$. See M. J. Nolte G. Gafner, and L. M. Haines. *Chem. Commun.,* 1406 (1969), and W. A. Anderson et al, *Canadian Journal of Chemistry,* 49, 761 (1971).

Q may be a mixture of different ligands if desired.

Still other photosensitive compounds of metals from Groups VIIIB and IB of the periodic table are described in Canadian Pat. No. 899,141, Canadian Pat. No. 905,733 and U.S. Pat. No. 3,880,724, the disclosures of which are hereby incorporated by reference.

Silver compounds, particularly silver halides are also useful radiation sensitive compounds for forming catalytic nuclei. Sensitive silver compounds and methods for their use are well known in the art. A detailed description can be found in Product Licensing Index, Vol. 92, December 1971, publication 9232.

Methods for the preparation, exposure and pretreatment of photographic elements containing the metal compounds described herein are given in detail in the respective above-noted references for the compounds.

To form light sensitive elements, the photosensitive compound may be either imbibed into a substrate or coated onto the substrate in a hydrophilic binder prior to imagewise exposure. Thus the substrate may be dipped in a bath of the compound and dried to render the element photosensitive. If desired, the compound may be added to a binder solution and coated onto the substrate by any means, such as dip coating, brushing, rolling, spraying hopper coating or the like.

The binder used as a vehicle for the photosensitive compound may be any of the hydrophilic binders used in photographic elements, including natural materials such as gelatin, albumin, agar-agar, gum arabic, alginic acid etc., and synthetic materials such as poly(vinyl alcohol), poly(vinyl pyrrolidone), cellulose esters, partially hydrolyzed cellulose acetate and the like. It is understood that although many binders may be used herein, the binder should be permeable to the developer used and should not absorb appreciably in the region of sensitivity of the compound. The compound may be used with varying amounts of binder material. Preferably, the compound to binder weight ratio is from about 3:1 to about 1:2.

The compound may be either imbibed into or coated into any support typically used for photographic elements. Support materials used herein are subject to wide variation. Glass may be employed as may be metals such as aluminum, copper, zinc, and tin. Conventional film bases, such as cellulose acetate, cellulose nitrate, cellulose acetate butyrate, poly(ethylene terephthalate), polystyrene and paper including polyethylene coated paper and polypropylene coated paper are also used. If the compound is to be imbibed in the support, porous materials such as paper should be used.

The elements are typically exposed through a pattern of actinic radiation providing a latent image corresponding to the exposed or unexposed areas. The palladium and copper complexes are sensitive to actinic radiation such as ultraviolet rays generally in the wavelength range of 1800 to 4000 Angstroms. Some of the complexes are sensitive to visible radiation and some may be spectrally sensitized. Many sources of ultraviolet light may be used such as high pressure mercury vapor lamps, carbon arc lamps, and the like. Some of these compounds are also sensitive to electron beam exposure, as well as exposure to neutrons and α-particles. As used herein, therefore, "electromagnetic radiation" is intended to include all of these forms of energy.

In some instances, the rate of development of the coated supports is considerably accelerated by heating the exposed elements prior to treatment with the physical developer. In this respect, a shorter exposure time to achieve a developable image may be used if the element is heated after exposure and prior to development. Generally, the element may be heated to about 100° C. to about 200° C. for about 1 to about 60 seconds to exhibit this effect.

Other methods which can be used to imagewise form catalytic nuclei include the imagewise destruction of the catalytic ability of nuclei by imagewise passing of a current through a substantially uniform layer of the developable catalyst. This process is fully described in commonly assigned copending U.S. application Ser. No. 824,136, filed Aug. 12, 1977, entitled "Electrophotographic Elements and Processes", now U.S. Pat. No. 4,113,388. Another useful method for imagewise forming catalytic nuclei is by including catalytic nuclei in toner particles which are then deposited in an imagewise manner by a xerographic process. This process is fully described in commonly assigned copending U.S. application Ser. No. 794,183, filed May 5, 1977, entitled "Amplification of Developed Electrographic Image Patterns." The full disclosure of both of these copending applications is hereby incorporated by reference.

After the imagewise catalytic nuclei are formed, a copper image is produced by disproportionating or reducing the heterocyclic ligand copper(I) complex in contact with the nuclei. This disproportionation or reduction step can be carried out by contacting the catalytic metal nuclei with a physical developer described above by any suitable method such as by immersing an element having the imagewise catalytic nuclei in the physical developer or by spraying the physical developer onto an element containing the catalytic metal nuclei. Alternatively, where the developer composition contains a suitable thickening agent, the composition can be spread on the element having the catalytic nuclei to develop the element.

The copper(I) complexes described above can be incorporated in a dry physical development composition. This composition can be coated either alone or with other layers on a suitable support to form a variety of useful elements. The dry physical development composition comprises (a) the described heterocyclic ligand copper(I) complex;

(b) a reducing agent as described which is capable of reducing the copper(I) complex; and (c) a thermal solvent.

These components (a), (b) and (c) are coated in layers which are in reactive association.

By "reactive association," as used herein, it is meant that the reactive components are in the same layer and/or in an adjacent layer and/or in a layer that is separated by a layer or layers that is permeable to the reactive components and byproducts. Thus, for example, the layer containing the heterocyclic ligand copper(I) complex, the layer containing the reducing agent and the layer containing the thermal solvent can all be the same layer, which is preferred, or three adjacent layers or two adjacent layers, one of which has two components, etc. Similarly, where the dry physical development composition is used with a photosensitive layer, these layers must be in reactive association as defined herein. It is preferred, however, that the photosensitive layer or layers be separate from the physical development layer or layers.

The dry physical development layers can be coated with a binder. Suitable binders include those listed above for the photosensitive element. Where the dry physical development layer is coated alone on a support to form an amplification element the support can be any of those listed above for the photosensitive element. While the dry physical development layer can be coated without a binder such as by imbibing the developer into a porous support, the binder coatings on nonporous supports are preferred.

The dry physical development layers contain a thermal solvent to provide a molten reaction environment. Heating of the layer in the presence of catalytic nuclei results in the deposition of copper on the nuclei. Depending on the particular thermal solvent, heating to between about 90° and about 180° C. is sufficient to activate the developer. Useful thermal solvents include: High molecular weight carboxylic acids such as stearic acid, docosanoic acid and the like; poly(ethylene glycols) such as Carbowax 6000 having a molecular weight of about 6000 to 7500, available from Carbide and Carbon Chemicals Corporation and the like; poly(ethylene oxides) such as Triton TX-100, an octylphenoxypolyethoxyethanol available from Rohm and Haas and the like; Polyox WSRN-10, a water soluble resin having a molecular weight of about 100,000 available from Union Carbide Chemicals; high molecular weight acetates such as octadecyl acetate and the like; methyl anisate; and others can be used.

The dry physical development composition can also contain a base precursor. In this embodiment, the development layer is coated using an acid coating composition. The coating composition can be made acidic by adding an acid, typically an organic acid such as toluene sulfonic acid, acetic acid and the like. Inorganic or Lewis type acids can also be used. Because reduction of the heterocyclic ligand copper(I) complex produces hydrogen ions, acid conditions within the layer favor the maintenance of the complex in its unreduced form. When the layer is made basic however, such as by the release of base from a base precursor, reduction of the copper(I) complex and deposition of copper(O) is favored. Thus, a layer which is stable for long periods can be prepared by coating the layer as an acid layer with a base precursor. Base precursors, which are typically activated by heat, are well known in the art. The base precursor should be chosen so that base is released at a temperature at least 10° C. lower than the decomposition temperature of the copper(I) complex. Useful base precursors are described in U.S. Pat. Nos. 3,531,285; 3,301,678; and 3,669,670; and *Research Disclosure* publications 12041, 12021, 15732, 15733, 15734, 15109 and 15776. Particularly preferred base precursors include sodium 4-hydroxybutyrate, D-galactonamide, 3-S-thiuronium propane sulfonate, guanidinium phenylsulfonyl acetate, bis(triethylenediamine) methylenebis(sulfonylacetate) and 2-(3-aminopropylthio)-2-thiazoline methylenebis(sulfonylacetate).

A wide variety of reducing agents can be used in the dry physical development compositions described herein. Useful reducing agents for these compositions include those described above for the reduction physical developer solutions. Preferred reducing agents for the dry compositions include 3,5-dialkylhydroquinones, ascorbic acid and mixtures of hydroquinones and ascorbic acid or ascorbates.

In one embodiment, the dry physical development layer or layers is coated alone on a support to provide an amplification element. The amplification element can be used to provide a positive image in the following manner. A photosensitive element is exposed in the usual manner and is then contacted with an amplification element into which has been imbibed the copper complex-reducing agent physical developer. In the unexposed areas of the photosensitive element, metal compounds diffuse to the amplification element where they are reduced by the reducing agent and catalyze the reduction of the copper(I) complex. Heat may be applied to promote the diffusion of the unexposed metal compounds. Contact temperatures of from 45° C. to 100° C. are suitable. The image formed in the amplification element can be used as such or it can be intensified by immersing the amplification element in a physical developer bath.

In yet another embodiment the dry physical development layer can be coated on a support in reactive association with a photosensitive layer. Thus, there is provided a photographic element comprising a support having coated thereon in reactive association (a) a layer comprising a compound capable of forming an image of catalytic nuclei on exposure to imagewise electromagnetic radiation;

(b) a layer comprising the copper(I) complex described above;

(c) a layer comprising a reducing agent; and (d) a layer comprising a thermal solvent.

A layer comprising a heat activatable base precursor can also be coated on the support. It is preferred that the copper(I) complex, reducing agent and thermal solvent are coated in the same layer along with a suitable binder.

Where the dry physical development layer is coated in reactive association with the nuclei forming electromagnetic radiation sensitive layer, a wide variety of layer configurations are possible. It is only necessary that it be possible to expose the radiation sensitive layer. For example, a radiation sensitive layer can be coated on a support which is substantially transparent. The dry physical development layer, which can be opaque, is then coated over the radiation sensitive layer. Imagewise exposure through the support and development such as by heating produces an image which can be viewed through the support. It will be readily appreciated that other configurations are also useful.

The following examples are presented for a further understanding of the invention Preparation of 3,5-dimethylisoxazole$(CuBr)_2$ (1)

To a solution of 11.2 g (0.05 mole) of $CuBr_2$ in 100 ml methanol was added 15.5 g (0.05 mole) of liquid triphenyl phosphite. Immediately, 7.0 g (0.07 mole) of 3,5-dimethylisoxazole was introduced with stirring. The solution quickly became colorless and deposited white crystals. The crystals were filtered by suction, washed with methanol and ether and dried in air overnight. The yield was 2.5 g (26%), m.p. 205°–212° C. (dec.).

The title compound was confirmed by elemental and solid state infrared spectrum analysis.

Preparation of 2-methylbenzoxazole(CuCl) (2)

To a solution of 17.0 g (0.10 mole) of $CuCl_2.2H_2O$ in 150 ml methanol was added 31.0 g (0.10 mole) of triphenyl phosphite liquid. Immediately 20 g (0.15 mole) of 2-methylbenzoxazole was added. The mixture was stirred and allowed to stand for 2 hours. The deposit of white crystals of the desired complex was filtered, washed with methanol and ether, and air dried for 1 hour with suction. The crystals darkened somewhat on drying but did not change form or appear to decompose. The yield was 14.1 g (61%).

The title compound was confirmed by elemental and solid state infrared spectrum analysis.

Preparation of benzoxazole(CuBr) (3)

To a stirred solution of 22.4 g (0.1 mole) $CuBr_2$ (anhydrous) in 150 ml methanol, was added a solution of 12 g (0.1 mole) of phenylhydrazine and 14 g (0.12 mole) benzoxazole. After stirring for 30 minutes, the crystals that had formed were washed well with methanol containing excess benzoxazole. After drying, 24.0 g of Cu(I) complex was obtained for a yield of 91 percent.

The title compound was confirmed by elemental and solid state infrared spectrum analysis.

The following complexes were made in a similar manner:

| | |
|---|---|
| 2-methylbenzothiazole(CuBr) | (4) |
| 2-methylbenzoxazole(CuBr) | (5) |
| 3,5-dimethylisoxazole$(CuCl)_2$ | (6) |
| 3,5-dimethylisoxazole$(CuBr)_2$ | (7) |
| 4,5-dimethylisoxazole(CuBr) | (8) |
| 3-methyl-5-phenylisoxazole$(CuBr)_2$ | (9) |
| 3-methyl-5-phenylisoxazole(CuCl) | (10) |

EXAMPLES 1–4

Compounds 4 through 7 were used to deposit copper from a disproportionation physical developer into silver nuclei. A developer formulation of each complex was made by mixing 0.1 g of the complex in 10 ml of ethylene glycol to which had been added 1 ml of 0.5 M triethylenetetraamine. Samples of a poly(ethylene terephthalate) strip upon which 0.5 mg/ft$^2$ (0.093 m$^2$) silver metal had been vacuum evaporated were immersed in each of the formulations. The strips were immersed for 5 minutes at room temperature, removed from the formulation and washed with water and ethanol. A uniform deposit of copper was observed on each strip in those areas having the silver nuclei.

EXAMPLES 5–7

The procedure of the previous examples was repeated using disproportionation developer formulations containing compounds 4, 5 and 9. Instead of the silver deposit, a deposit of 0.15 mg/ft$^2$ (0.093 m$^2$) of palladium was used. A copper deposit resulted in each case in those areas having the palladium deposit.

EXAMPLES 8–17

Compounds 1 through 10 were used to deposit copper from a reduction physical developer onto silver nuclei. A developer formulation of each complex was made by adding a saturated solution of the complex in ethylene glycol to an equal volume of an ethylene glycol solution which was 0.25 molar in hydroquinone and 0.05 molar in ascorbic acid. The resulting solutions were made basic by adding dimethylethanolamine. Samples of a poly(ethylene terephthalate) strip upon which 0.5 mg/ft$^2$ (0.093 m$^2$) had been vacuum evaporated were immersed in each of the formulations. The strips were immersed for 1 to 5 minutes at 95° C., removed from the formulation and washed with water and ethanol. As in previous examples, a uniform deposit of copper was observed on each strip in those areas having the silver nuclei.

EXAMPLES 18–24

The procedure of Examples 8 through 17 was repeated, using reduction developer formulations containing compounds 4 through 10. Instead of the silver deposit, a deposit of 0.15 mg/ft$^2$ (0.093 m$^2$) of palladium was used. A copper deposit resulted in each case in those areas having the palladium deposit.

EXAMPLE 25

A mixture of 1 g of 2-methylbenzothiazole(CuBr), 3 g of 2,5-di-t-butyl-hydroquinone, 4 g of stearic acid, 20 ml of a 5 percent solution of poly(vinyl butyral) in acetone and 10 ml of acetone was ball milled for 5 hours. The resulting coating composition was coated at a wet thickness of 10 mils on poly(ethylene terephthalate) support which had been subbed according to U.S. Pat. No. 3,271,345 and dried. The coated layer of this amplification element was laminated in contact with a layer of palladium nuclei which had been coated on a separate piece of poly(ethylene terephthalate) support. The laminate was heated for one minute at 180° C. after which the support having the layer of palladium nuclei was separated from the amplification element. A deposit of copper was observed on the palladium nuclei.

The invention has been described in detail with particular reference to preferred embodiments thereof, but it will be understood that variations and modifications can be effected within the spirit and scope of the invention.

What is claimed is:

1. A physical developer formulation comprising:

(a) a solvent;

(b) a copper(I) complex represented by the formula:

$L(CuX)_m$ wherein L is a monodentate or bidentate heterocyclic ligand selected from the group consisting of:

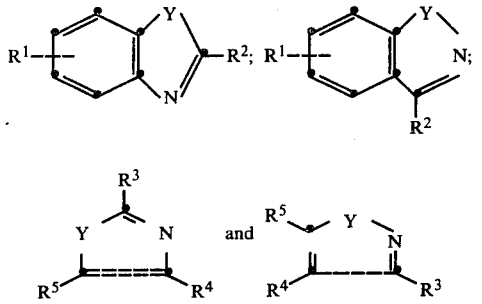

wherein Y is oxygen or sulfur; $R^1$ is alkyl having from 1 to 20 carbon atoms or aryl having from 6 to 20 carbon atoms; $R^2$ through $R^5$ are independently selected from the group consisting of hydrogen, alkyl having from 1 to 20 carbon atoms, and aryl having from 6 to 20 carbon atoms; with the proviso that at least one of $R^3$ through $R^5$ is hydrogen;

X is an anion; and m is the integer of 1 or 2;

(c) a reducing agent capable of reducing said copper(I) complex in the presence of catalytic nuclei but which does not spontaneously reduce said copper(I) complex; and (d) a base;

wherein said formulation is 0.005 to 0.5 molar in said copper(I) complex.

2. The physical developer of claim 1 wherein L is a benzoxazole or a benzothiazole and X is a halide.

3. The physical developer of claim 1 wherein said solvent is a polar organic solvent.

4. The physical developer of claim 1 wherein said formulation is 0.01 molar to 0.1 molar in said copper(I) complex.

5. The physical developer of claim 1 wherein said reducing agent is selected from the group consisting of hydroquinones, catechols and pyrogallols, ascorbic acid and ascorbic acid derivatives.

6. The physical developer of claim 1 wherein said reducing agent is a mixture of hydroquinone and ascorbic acid.

7. The physical developer of claim 2 wherein said copper(I) complex is selected from the group consisting of 2-methylbenzoxazole (CuBr) and 2-methylbenzothiazole (CuBr).

8. A process for producing a copper image comprising the steps of:

(a) imagewise forming catalytic metal nuclei; and (b) forming said copper image by catalytically reducing a copper(I) complex in contact with said nuclei, with a reducing agent that does not spontaneously reduce said copper(I) complex, said copper(I) complex having the formula:

$L(CuX)_m$ wherein L is a monodentate or bidentate heterocyclic ligand selected from the group consisting of:

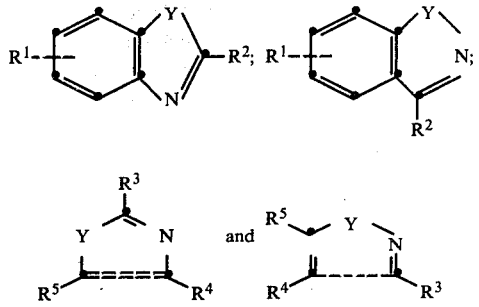

wherein Y is oxygen or sulfur; $R^1$ is alkyl having from 1 to 20 carbon atoms or aryl having from 6 to 20 carbon atoms; $R^2$ through $R^5$ are independently selected from the group consisting of hydrogen, alkyl having from 1 to 20 carbon atoms, and aryl having from 6 to 20 carbon atoms; with the proviso that at least one of $R^3$ through $R^5$ is hydrogen;

X is an anion; and m is the integer of 1 or 2.

9. A process according to claim 8 wherein L is a benzoxazole or a benzothiazole and X is a halide.

10. The process according to claim 8 wherein said reducing agent is selected from the group consisting of hydroquinones, catechols and pyrogallols, ascorbic acid and ascorbic acid derivatives.

11. The process according to claim 8 wherein said reducing agent is a mixture of hydroquinone and ascorbic acid.

12. A process according to claim 8 wherein said imagewise catalytic nuclei are formed by imagewise exposing to electromagnetic radiation an electromagnetic radiation sensitive compound of a metal from group VIII or IB of the periodic table.

13. A process according to claim 12 wherein said radiation sensitive compound is a complex of palladium or copper.

14. The process according to claim 8 wherein said copper(I) complex is selected from the group consisting of 2-methylbenzoxazole(CuBr) and 2-methylbenzothiazole (CuBr).

15. A photographic element comprising a support having coated thereon:

(a) a layer comprising a compound capable of forming an image of catalytic nuclei on exposure to imagewise electromagnetic radiation;

(b) a layer comprising, in an amount sufficient to produce a copper image, a copper(I) complex having the formula:

$L(CuX)_m$ wherein L is a monodentate or bidentate heterocyclic ligand selected from the group consisting of:

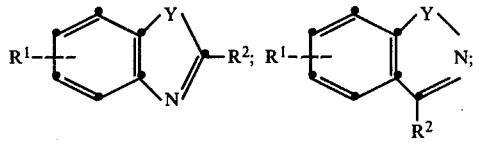

-continued

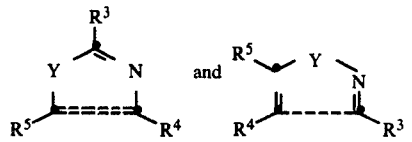

wherein Y is oxygen or sulfur; $R^1$ is alkyl having from 1 to 20 carbon atoms or aryl having from 6 to 20 carbon atoms; $R^2$ through $R^5$ are independently selected from the group consisting of hydrogen, alkyl having from 1 to 20 carbon atoms, and aryl having from 6 to 20 carbon atoms; with the proviso that at least one of $R^3$ through $R^5$ is hydrogen;

X is an anion; and m is the integer of 1 or 2; and (c) a layer comprising a reducing agent capable of reducing said copper(I) complex in the presence of said catalytic nuclei but which does not spontaneously reduce said copper(I) complex; and (d) a layer comprising a thermal solvent, said layers being in reactive association with one another.

16. An element according to claim 15 wherein (b), (c) and (d) are the same layer.

17. An element according to claim 15 wherein said reducing agent is selected from the group consisting of hydroquinones, ascorbates, and mixtures of hydroquinones and ascorbic acid.

18. An element according to claim 15 wherein said thermal solvent is selected from the group consisting of high molecular weight carboxylic acids; poly(ethylene glycols); poly(ethylene oxides); and high molecular weight acetates.

19. An element according to claim 15 wherein said radiation sensitive compound is a complex of palladium or copper.

20. An element according to claim 15 wherein each of said layers (a), (b), (c) and (d) further comprises a binder.

21. An element according to claim 15 wherein L is a benzoxazole or a benzothiazole and X is a halide.

22. An element according to claim 15 wherein said copper(I) complex is selected from the group consisting of 2-methylbenzoxazole(CuBr) and 2-methylbenzothiazole (CuBr).

23. An amplification element comprising:

(a) a layer comprising a copper(I) complex represented by the formula $L(CuX)_m$ wherein L is a monodentate or bidentate heterocyclic ligand selected from the group consisting of:

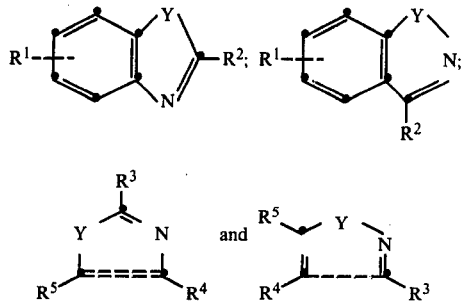

wherein Y is oxygen or sulfur; $R^1$ is alkyl having from 1 to 20 carbon atoms or aryl having from 6 to 20 carbon atoms; $R^2$ through $R^5$ are independently selected from the group consisting of hydrogen, alkyl having from 1 to 20 carbon atoms, and aryl having from 6 to 20 carbon atoms; with the proviso that at least one of $R^3$ through $R^5$ is hydrogen;

X is an anion; and m is the integer of 1 or 2; and (b) a layer comprising a reducing agent capable of reducing said copper(I) complex in the presence of catalytic nuclei but which does not spontaneously reduce said copper(I) complex; and (c) a layer comprising a heat activatable base precursor said layers being in reactive association.

24. An element according to claim 23 wherein (a), (b) and (c) are the same layer.

25. An element according to claim 23 wherein said reducing agent is selected from the group consisting of hydroquinones, ascorbates and mixtures of hydroquinones and ascorbates.

26. An element according to claim 23 wherein each of said layers (a), (b) and (c) further comprises a binder.

27. An element according to claim 23 wherein L is a benzoxazole or a benzothiazole and X is a halide.

28. An element according to claim 23 wherein said copper(I) complex is selected from the group consisting of 2-methylbenzoxazole(CuBr) and 2-methylbenzothiazole (CuBr).

* * * * *